US009422679B1

(12) United States Patent
Zurcher

(10) Patent No.: US 9,422,679 B1
(45) Date of Patent: Aug. 23, 2016

(54) GLASS BEAD DISPENSING APPARATUS CONVERTIBLE BETWEEN HAND-HELD AND MOUNTED TO A WALK-BEHIND PAVEMENT LINE STRIPER

(71) Applicant: D & L Zurcher Enterprises, Inc., Columbus, OH (US)

(72) Inventor: Daniel Eugene Zurcher, Columbus, OH (US)

(73) Assignee: Daniel Eugene Zurcher, Columbus, OH (US)

( * ) Notice: Subject to any disclaimer, the term of this patent is extended or adjusted under 35 U.S.C. 154(b) by 0 days.

(21) Appl. No.: 14/568,534

(22) Filed: Dec. 12, 2014

Related U.S. Application Data

(60) Provisional application No. 61/915,833, filed on Dec. 13, 2013.

(51) Int. Cl.
*A01G 25/09* (2006.01)
*E01C 23/16* (2006.01)
*E01C 23/22* (2006.01)

(52) U.S. Cl.
CPC ..... *E01C 23/166* (2013.01); *E01C 23/22* (2013.01)

(58) Field of Classification Search
CPC . B05B 7/0093; B05B 7/1693; B05B 9/0409; B05B 13/005; E01C 23/222; E01C 23/22; F16H 59/0217; F16H 61/4035
USPC ..... 239/146, 147, 149, 150, 375; 118/305, 118/323; 404/83, 93
See application file for complete search history.

(56) References Cited

U.S. PATENT DOCUMENTS

| | | | | |
|---|---|---|---|---|
| 3,687,371 | A | 8/1972 | Swager | |
| 4,624,602 | A | 11/1986 | Kieffer et al. | |
| 4,877,348 | A * | 10/1989 | Opie | E01C 23/22 118/300 |
| 5,302,207 | A * | 4/1994 | Jurcisin | E01C 23/22 118/207 |
| 5,368,232 | A | 11/1994 | Schroeder | |
| 5,947,385 | A | 9/1999 | Lanerd et al. | |
| 6,478,507 | B2 | 11/2002 | Schroeder et al. | |
| 7,237,783 | B2 | 7/2007 | Kieffer et al. | |
| 7,673,815 | B2 | 3/2010 | Schroeder et al. | |
| 8,061,295 | B2 * | 11/2011 | Zimmerman | E01C 23/166 118/308 |

OTHER PUBLICATIONS

Graco Inc, Instructions-Parts List, Kit, Beads Dispenser, 1999, pp. 1-8, 308940J, Graco Inc., Minneapolis, MN.
Titan Wagner Striper (photo of).

* cited by examiner

*Primary Examiner* — Davis Hwu

(57) ABSTRACT

A glass bead dispensing apparatus for alternatively being manually held and operated or attached to a walk-behind pavement line striper. A glass bead dispenser is mounted to the horizontal support bar of the line striper so it can be vertically adjusted or quickly demounted for manual use. A bead gate actuation cable extends between the bead dispenser and a forward mounting block for applying glass beads when the paint sprayer of the line striper is actuated. A direction-reversing bell crank is pivotally mounted to the forward mounting block. A sprayer operator connecting link is connected between the direction-reversing bell crank and the paint sprayer operator. For hand held operation, a handle bar is attachable to an upstanding support post of the bead dispenser and has a hand-actuable lever attachable to the gate actuation cable for manually opening and closing the bead gate.

13 Claims, 6 Drawing Sheets

GLASS BEAD DISPENSING APPARATUS CONVERTIBLE BETWEEN HAND-HELD AND MOUNTED TO A WALK-BEHIND PAVEMENT LINE STRIPER

CROSS-REFERENCES TO RELATED APPLICATIONS

This application claims the benefit of U.S. Provisional Application No. 61/915,833 filed 13 Dec. 2013.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

This invention relates generally to painting equipment for spray painting lines and traffic control indicia on pavement and more particularly relates to a glass bead dispensing apparatus for applying reflective glass beads onto a freshly painted line. The invention provides cost savings, improved convenience and enhanced operation of a walk behind, wheeled line striper, which is a machine in common use throughout the world. The invention also provides a glass bead dispensing apparatus that is easily demountable from the line striper for alternative use as a hand held bead dispenser.

Most painting contractors, who paint lines and traffic control indicia on pavement, use one of a few walk behind, wheeled line stripers purchased from two major manufacturers of these machines. An example is illustrated in FIG. 1 and some of its structural parts will be subsequently described in more detail. The wheeled line striper is a wheeled carriage which carries spray painting equipment including a paint sprayer, a paint supply tank, a high pressure paint pump suitable for applying a high pressure to the paint so that paint exits the sprayer under high pressure, an engine for powering the paint pump and interconnecting conduits for conveying paint. The carriage can be propelled by an on-board engine or pushed by a human operator or a separate ridden engine. A hand trigger is mounted to carriage handles at the rear of the carriage where the trigger is accessible to a human operator who is propelling the line striper during a line painting operation. The hand trigger is connected to the sprayer by a mechanical link, such as an actuation cable, for manually actuating the sprayer to paint a line as the line striper moves along the pavement Although the sprayer can be fixed to the line striper, the sprayer of most line stripers is a demountable paint spray gun that is supported in a spray gun cradle. The line striper has a movable sprayer operator that moves the spray gun trigger to initiate spraying when the painter, who is walking or riding behind the line striper, actuates the hand trigger at the rear of the line striper. The cradle also allows the paint spray gun to be detached from the cradle so that the painter can use the spray gun to manually paint indicia other than stripes on the pavement. For example, a painting contract may include not only the painting of lines but may additionally include painting lane turning arrows, words or handicap parking symbols using stencils. The detachability of the paint spray gun allows the use of a single spray gun, which is conveniently available and easily accessible to the painter, for both manually painting such indicia and then returning the paint spray gun to the line striper to resume painting lines.

Many painting contracts require the application of glass beads to the paint in order to make the painted lines and traffic indicia reflect light from vehicles or other light sources. The beads must be applied while the paint surface is tacky or wet so they will adhere to the paint. In an attempt to provide this function for line painting, glass bead dispensers have been mounted to prior art line stripers aft of the paint sprayer. An example is shown in U.S. Pat. No. 6,478,507. [Because line stripers are vehicles that move across pavement when performing their painting operation, the terms front, back, rear, fore, forward and aft are used to describe relative positions and orientations and have meanings that are equivalent to the manner those words are applied to automobiles and boats]

In order to support both the paint sprayer and the glass bead dispenser on the line striper, line stripers have a horizontal support bar to which the paint spray gun cradle and the glass bead dispenser are mounted. This horizontal support bar extends in a fore/aft orientation, parallel to the line of travel of the striper. The sprayer is mounted forward of the bead dispenser so that glass beads from the dispenser can fall onto a freshly painted stripe as the line striper moves along the pavement. Ordinarily, the horizontal support bar can be raised and lowered in order to raise and lower the sprayer. Because the paint is sprayed from the sprayer nozzle in a diverging fan pattern, the width of the painted line can be increased and decreased by respectively raising and lowering the support bar and with it the sprayer.

Although the prior art line sprayers perform their intended function well, they also have some important deficiencies and problems which the present invention solves. Generally, the present invention provides enhanced cost benefits added convenience and avoidance of some operational and maintenance problems.

One deficiency of the prior art line stripers is that the glass bead dispenser is permanently mounted to the line striper. The result is that a painting contractor must either buy a second, hand-held bead dispenser or dispense glass beads onto freshly painted indicia from his or her hand or a hand held container. However, dispensing glass beads from the hand results in a bead distribution that is irregular and leaves areas of insufficient concentration and therefore less reflectivity. Casting glass beads onto the paint from the height of a human hand above the pavement permits a wind to carry many of the beads onto unpainted surfaces of the pavement. Those beads are wasted and cannot practically be retrieved.

Therefore, there is a need for a glass bead dispensing apparatus that can be quickly and easily demounted from the line striper, converted to a manual bead dispenser, used to apply glass beads to traffic indicia that were hand painted with a stencil and then quickly and easily returned to the line striper. The ease and timing for making these conversions are important because the painter wants to spend as little time as possible detaching, assembling or reattaching tools because doing so extends the time required for completing performance of the paint contract.

Another shortcoming of prior art line stripers is that their glass bead dispensers are not vertically adjustable independently of their sprayer. Although line stripers permit the horizontal support bar to be vertically adjusted to raise and lower the sprayer in order to widen or narrow the sprayed line, their bead dispenser, which is mounted to that horizontal support bar, is raised and lowered with the support bar. Consequently, when the horizontal support bar is raised, the bead dispenser is also raised to a greater height above the pavement. That greater height allows a wind to blow the dispensed beads farther from the painted line where they fall on unpainted surfaces of the pavement. This also leaves areas of insufficient bead concentration and less reflectivity Therefore, there is a need for a bead dispenser that can be raised and lowered independently of the horizontal support bar so that, when the support bar is raised, the bead dispenser can be lowered down to a more desirable lower height above the pavement where the dispensed beads are less susceptible to deflection by the wind.

Yet another problem with the prior art presents a dilemma to a designer who applies the prior art to the design of a line striper. Bead dispensers have a bead container with a horizontal exit slot near their bottom and a gate that pivots between a position blocking the exit slot and a position away from the exit slot to permit glass beads to pour out through the exit slot onto a freshly painted line. Some prior art line stripers have their bead dispenser oriented on the line striper with their gate on their upstream side of the dispenser facing forward toward the paint sprayer. Other line stripers have their bead dispenser oriented on the line striper with the gate on their downstream stream side facing aft away from the paint sprayer. However, each orientation presents a different problem but the invention solves both.

If a line striper of the prior art has its bead dispenser gate on the forward side of the bead dispenser so that it faces upstream toward the paint sprayer, suspended paint droplets that have not contacted the pavement are blown by a wind onto the bead dispenser. This overspray accumulates on the bead container of the dispenser and its gate, which is open during spraying. Particularly troublesome is the accumulation of paint on interfacing surfaces between the gate and the dispenser container in the area around the exit slot. Paint accumulated on these surfaces interferes with the dispenser's operation, for example by causing the gate to stick closed or causing any gasket material on the gate to stick to the bead container when the gate is closed and be torn away when it is opened.

Other line stripers of the prior art have their bead dispensers oriented in the opposite direction so their bead dispenser gate is on the aft side of the bead dispenser facing downstream away from the paint sprayer. In this aft-facing orientation, the bead container acts as a shield which avoids the above-described overspray problem but adds a new problem. If the pavement has an uneven surface such as hills, ledges or a protruding stone, the bottom of the gate can scrape or drag along the pavement. This frictional engagement with the pavement pulls the gate open. That is not a significant problem while spraying a line because whenever the painter, who is walking behind the striper, has actuated the trigger handle on the line striper, the bead dispenser is already opened. So paint is applied to the pavement and beads are applied onto the undried paint with little or no undesirable consequence.

However, scraping the gate along the pavement becomes a problem with a prior art line sprayer if the scraping happens when the line sprayer is being moved from the end of a line into position for painting the next line. It is obviously undesirable for paint to be sprayed onto an unintended area of the pavement while moving the line sprayer from one line to the next line. The painter must stop painting and clean that paint off the pavement. However, with prior art line sprayers, if the gate drags along the pavement and is pulled open while the line sprayer is moving between locations of desired paint applications, the movement of the gate to its open position also triggers the sprayer and causes paint to be sprayed. The result is that paint is sprayed onto the pavement at an unwanted location and continues to be sprayed until the gate rises above the pavement and closes. The reason for this unwanted spray is that the prior art has a fixed length, solid rigid rod that links the sprayer trigger to the bead dispenser gate for opening the gate when the sprayer is actuated. The problem with the prior art is that the trigger of the sprayer and the gate of the bead dispenser move in unison regardless of which is forced to its open position.

Therefore, there is a need for a bead dispenser apparatus that allows the bead dispenser gate to face downstream so it is shielded by the bead container but will not cause the paint sprayer to be accidentally actuated if the bead gate is inadvertently scraped open by a high spot on the pavement.

Another inadequacy of prior art line stripers is that the fore and aft distance of their bead dispenser from the sprayer cannot be adjusted or varied because their bead dispenser is fixed to the horizontal support bar. A painter may want to change the distance of the bead dispenser from the sprayer in order to apply the beads sooner after a paint with highly volatile solvent is applied to a hot pavement in order to control the paint drying time until the beads are applied to the paint. Also, the painter may want to move the bead dispenser farther from the sprayer on a windy day to minimize the overspray that blows onto the bead dispenser. Unfortunately, even if an owner of a line striper wished to vary that distance, the distance cannot be varied because of the rigid actuating link connected to the bead dispenser. Any fore and aft relocation of the prior art bead dispenser would result in the gate of the bead dispenser failing to open or would result in it being permanently held open at all times. Therefore, there is a need for a bead dispensing apparatus that permits the bead dispenser to be adjustably moved closer or farther from the sprayer.

Additionally, since the bead dispensing apparatus of the present invention is an after-market product that is installed on the line striper by the painter, there is a need for a bead dispenser that does not require that it be mounted at a critically precise location on the line striper's horizontal support bar but rather can be attached anywhere within a wide range of fore and aft locations.

BRIEF SUMMARY OF THE INVENTION

The glass bead dispensing apparatus has a glass bead container with a laterally oriented exit slot, a gate opening and closing the exit slot and an upstanding support post. An aft mounting block is attachable to the horizontal support bar of the line striper and the support post of the bead dispenser is vertically, adjustable and fixable to the aft mounting block in a selected vertical adjustment. A bead gate actuation cable has its aft end attached to the bead dispenser for opening the gate in response to a tension force applied to an opposite forward end of the gate actuation cable. The forward end of the gate actuation cable is removably attachable to a forward mounting block that is also attachable to the horizontal support bar. The forward end of the gate actuation cable is drivingly linked to a sprayer operator so that the sprayer operator applies a tension force upon the gate actuation cable for opening the bead gate when the sprayer operator actuates the sprayer. For use as a hand held bead dispenser, the gate actuation cable and the bead dispenser are easily and quickly removed from the line striper. After removal, a handle bar is attachable to the upstanding support post of the bead dispenser and has a hand-actuable lever that connects to the forward end of the gate actuation cable for manually opening the bead gate.

Figure 1:
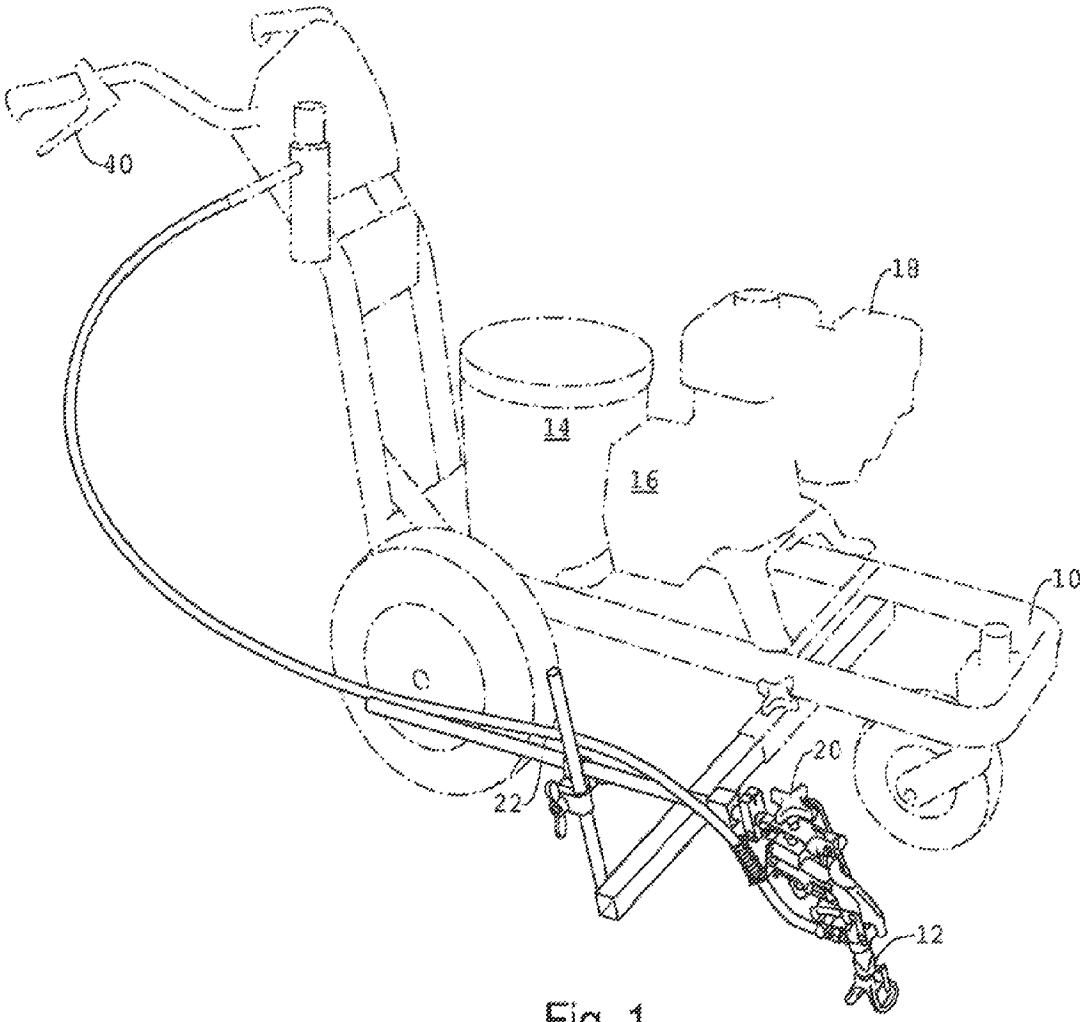
FIG. 1 is a view in perspective of a line striper of the prior art to which an embodiment of the invention can be mounted.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

U.S. Provisional Application No. 61/915,833 filed 13 Dec. 2013 is herein incorporated by reference.

Line Striper and it's Paint Sprayer

FIG. 1 illustrates an example of a popular, prior art, walk-behind pavement line striper. The line striper is a wheeled carriage 10 on which are mounted a paint sprayer 12 with its supporting paint supply reservoir 14, a high pressure paint pump 16 suitable for an airless paint sprayer and an engine 18 for driving the pump 16. The paint sprayer 12 is preferably a hand operable paint spray gun detachably mounted in a spray gun cradle 20.

Figure 2:
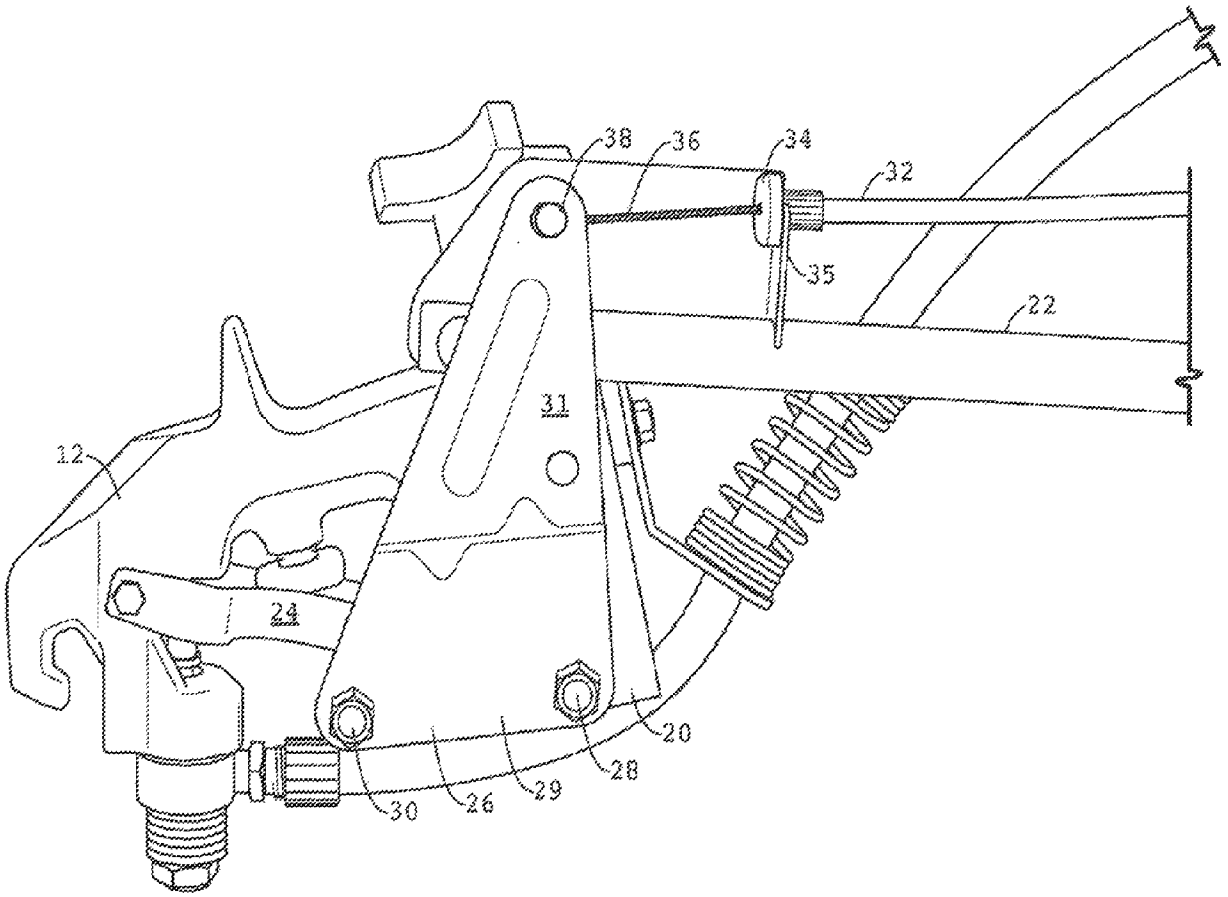
FIG. 2 is a side view of the horizontal support bar of the line striper of FIG. 1 on which is mounted a sprayer gun, sprayer gun cradle and the sprayer gun actuation mechanism.

Referring to FIGS. 1 and 2, the line striper has a horizontal support bar 22 that extends in a fore/aft orientation parallel to the line of travel of the line striper. The purpose of the horizontal support bar 22 is to provide a structure to which the paint sprayer 12 and, if desired, a bead dispenser is attached. The horizontal support bar is mounted to the line striper so that it is vertically adjustable. The spray gun cradle 20 that receives the paint sprayer 12 is attached to the support bar 22 near its forward end so that the support bar 22 extends aft of the sprayer 12.

The paint spray gun 12 is actuated by a conventional spray gun trigger 24 to initiate spraying when moved in one direction (upward in FIG. 2) and to stop the spraying when returned in the opposite direction by its spring bias. When the paint sprayer 12 is in the cradle 20, a movable paint sprayer operator 26 actuates the trigger 24. The paint sprayer operator 26 is a triangular bell crank that is pivotally mounted at a pivot axis 28 to the horizontal support bar 22 through intermediate attachment to the sprayer cradle 20 with the pivot axis 28 lower than the horizontal support bar 22. The sprayer operator 26 has a forwardly extending lever arm 29 with a protruding finger 30 fixed to its end. The finger 30 extends from the sprayer operator 26 to beneath the underside of the sprayer trigger 24. The sprayer operator 26 also has an upwardly extending lever arm 31 for attachment to a sprayer actuation cable 32.

The sprayer actuation cable 32 has the forward end of its outer conduit seating in a conduit fitting 34 that in turn is attached to a conduit fitting support 35 fixed to the horizontal support bar 22. The core of the actuation cable 32 is attached to a core fitting 38 that is fixed to the top of the upwardly extending lever arm 31 of the paint sprayer operator 26. The opposite end of the actuation cable 32 is connected to a hand trigger 40 (FIG. 1) at the rear of the line striper to permit the paint contractor to remotely start and stop spraying paint. More specifically, when the paint contractor squeezes the hand trigger 40, the sprayer actuation cable 32 pulls the upwardly extending lever arm 31 aft which pivots the paint sprayer operator 26 in one direction (clockwise in FIG. 2) about its pivot axis 28. That rotation moves the finger 30 upward to actuate the paint sprayer trigger 24 and thereby initiates spraying. When the paint contractor releases the hand trigger 40, the return spring of the paint spray gun 12 forces the spray gun trigger 24 against the finger 30 which pivots the paint sprayer operator 26 in the opposite direction (counterclockwise in FIG. 2) about the pivot axis 28 and spraying stops.

Forward and Aft Mounting Blocks

FIGS. 3 through 8 illustrate an embodiment of the invention that is mounted to the horizontal support bar 22 of the prior art line striper. Its components are mounted to the horizontal support bar 22 by a forward mounting block 42 and an aft mounting block 44 which are both attached to the horizontal support bar 22. The mounting blocks used with the invention are themselves known in the prior art. Each is a metal block with one or two holes. The holes receive a rod, bar or post (hereinafter "bar") and have a size and interior wall contour to slidingly mate with a bar that is inserted through the holes. Both of the mounting blocks 42 and 44 have a hole that matingly receives, and is slightly larger than, the horizontal support bar 22 so that the mounting blocks 42 and 44 can be slid along the horizontal support bar 22. Both of the mounting blocks 42 and 44 also have a fastener for fixing the block in position on the horizontal support bar 22 so that, after being fastened to the support bar 22, the mounting block cannot slide along the support bar 22. Each mounting block is preferably split by a slot 46 that is parallel to the hole to permit threaded fasteners 48, which extend across the slot 46, to clamp the block to a fixed position on the support bar 22. However, alternative and different fastening systems can be used including set screws in the block that seat against the bar or a series of holes spaced along the bar and a hole through the block so that a pin can be inserted through the hole in the block and any of several holes through and spaced along the bar. Because the horizontal support bar 22 is typically cylindrical, both mounting blocks have a hole that is cylindrical and horizontally aligned in their operable orientation for attachment to the horizontal support bar 22.

The aft mounting block 44 is attached to the horizontal support bar 22 aft of the forward mounting block 42. Its purpose is to removably support a glass bead dispenser at a desired location as will be subsequently described. One convenient feature of the invention is that once the mounting blocks 42 and 44 are attached to the horizontal support bar 22, neither of them needs to be removed when the glass bead dispenser is temporarily removed for hand application of glass beads.

Glass Bead Dispenser

Figure 3:
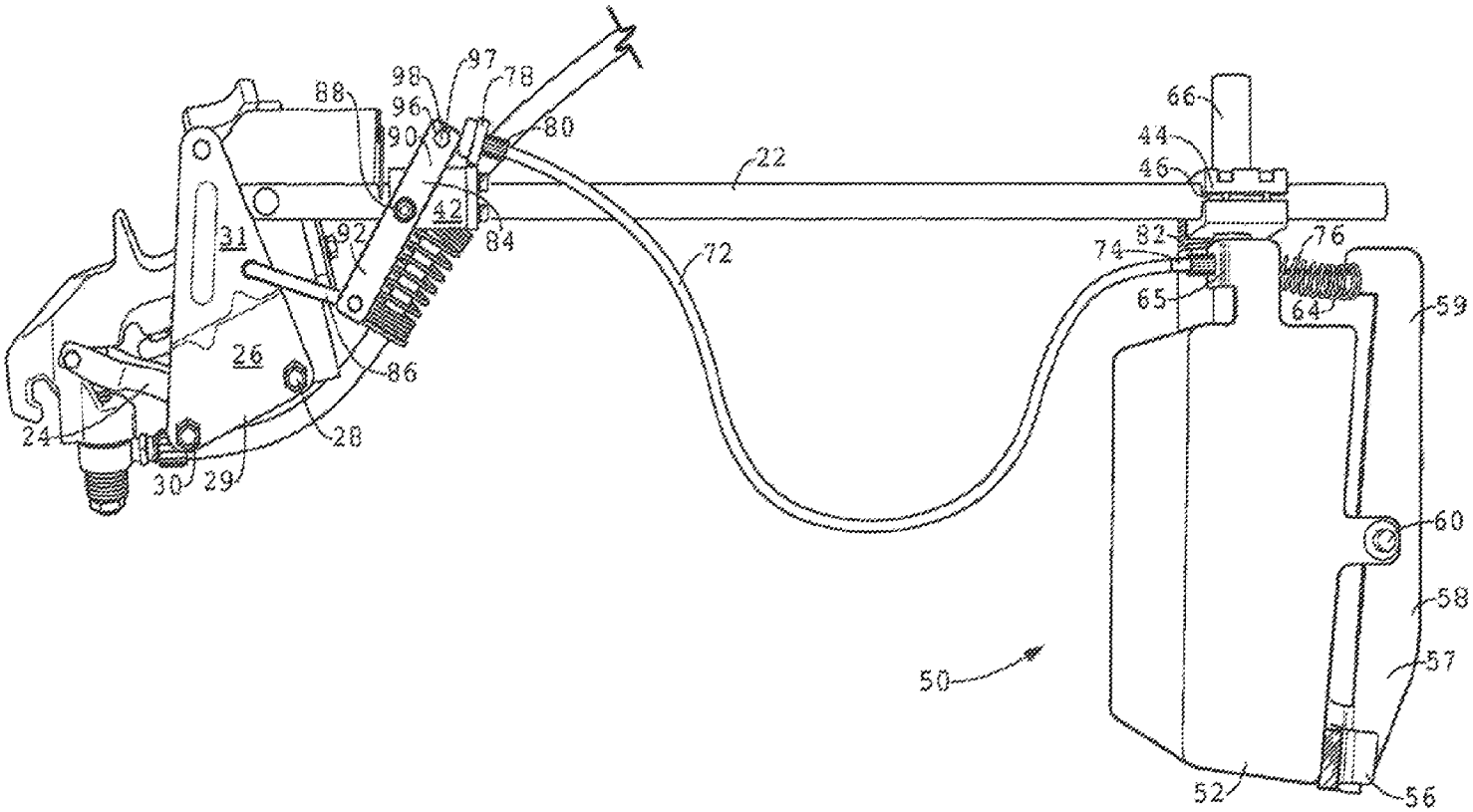
FIG. 3 is a side view like FIG. 2 but with an embodiment of the invention also mounted on the horizontal support bar.
Figure 5:
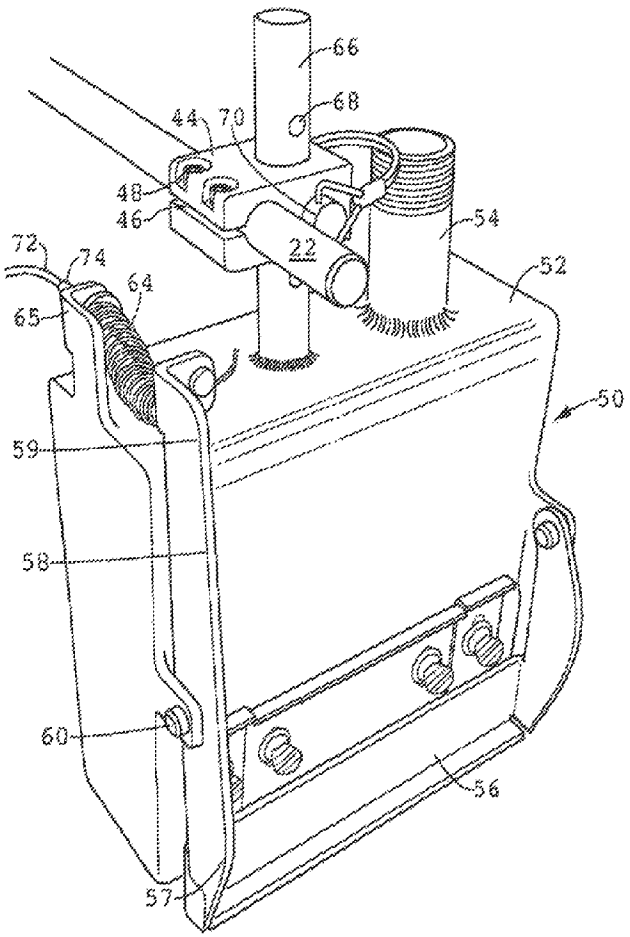
FIG. 5 is a view in perspective of the glass bead dispenser and the structures for mounting it to the horizontal support bar in accordance with the invention.

The glass bead dispenser 50 and the manner of attaching it to the aft mounting block 44 are illustrated in FIGS. 3, 5. 6 and 7. The glass bead dispenser 50 has a glass bead container 52 which is a reservoir filled with a supply of glass beads. The bead container 52 is filled through a hole in its top which preferably has an upstanding fill tube 54. The fill tube can be connected to a remote reservoir or tank for holding a larger supply of glass beads that are fed by gravity into the bead container 52. At the bottom of the bead container 52 is a container opening in the form of a laterally oriented and horizontal bead exit slot through which glass beads fall out by gravity when the exit slot is not blocked.

For controlling the outflow of glass beads, the bead dispenser 50 has a bead dispenser gate 56 that is movable between a position blocking the exit slot and a position opening the exit slot. The gate 56 has a gate operator 58 which is a lever mounted at a central pivot axis 60 to the bead container 52 for moving the gate 56 between its opened and closed positions. The lower lever arm 57 of the gate operator 58 is attached to the gate 56 below the pivot axis 60. The upper lever arm 59 of the gate operator 58 extends upward above the pivot axis 60 for connection to the aft end of a gate actuation cable 72 that opens the gate 56 and is described below. The gate 56 also has a pliant material forming a gasket 62 for making a tighter seal against the bead exit slot. A spring 64 biases the gate operator 58 in a direction of rotation that closes the gate 56 against the bead exit slot. For mounting the aft end of the gate actuation cable 72, an actuation cable conduit mounting arm 65 is attached to the bead container 52 and is spaced from the gate operator 58. As will be seen, the core of the gate actuation cable 72 is attached to the gate operator 58 so that a tension force applied to the opposite end of the core pulls the gate operator 58 in a direction of rotation that opens the gate 56.

An upstanding bead container support post 66 is fixed to the top of the bead container 52 for attachment to the aft mounting block 44. For this purpose, the aft mounting block 44 additionally has a second hole oriented with its axis in a vertical orientation, in the operable attached orientation of the aft mounting block, for receiving the upstanding support post 66 of the bead dispenser 50. The vertical hole or opening is a guide surface for maintaining the bead dispenser support post 66 in a vertical orientation while allowing the support post 66, along with the entire bead dispenser 52, to be vertically adjusted and then fixed at a selected height above the pavement without any need to move the horizontal support bar 22. This also permits the entire bead dispenser 52 to be easily removed for use as a hand held bead dispenser.

Horizontal adjustment of the distance from the sprayer 12 to the bead dispenser 50 is possible by mounting the bead dispenser 50 to a slidable, aft mounting block 44. Vertical adjustment of the bead dispenser 50 to a selected height above the pavement, rapid removal of the bead dispenser 50 from the line striper for use as a hand held bead dispenser, rapid attachment of the bead dispenser 50 to a handle and rapid replacement of the bead dispenser 50 on the line striper are all made possible by the manner of fixing the position of the bead dispenser support post 66 in the aft mounting block 44. A series of diametrically oriented holes 68 are vertically spaced at 1 inch intervals along the bead dispenser support post 66. A horizontal hole through the aft mounting block 44 can be aligned with any of the holes 68 through the support post 66 by vertically sliding the support post 66 along the vertical hole through the aft mounting block 44. When the horizontal holes are brought into registration, a linchpin 70 is inserted through the holes to retain the support post 66 in the selected position in the aft mounting block 44. For vertical adjustment of the height of the bead dispenser 50 above the pavement after the horizontal support bar 22 has been raised or lowered, the linchpin 70 is removed, the support post 66 is vertically slid through the vertical hole in the aft mounting block 44 and the linchpin 70 is reinserted with the bead dispenser 50 at a selected height. For removal of the bead dispenser 50 from the aft mounting block 44, the linchpin 70 is withdrawn from its aligned horizontal holes and then the bead dispenser support post 66 along with the entire bead dispenser 50 is lowered out of the aft mounting block 44. As will subsequently be described, the bead dispenser 50 is also quickly mounted to a tubular handle by aligning similar holes in the handle with one of the holes 68 through the bead dispenser support post 66 and inserting the linchpin 70.

Actuation Connection from Sprayer to Bead Dispenser

Of critical importance for obtaining several of the improvements of the invention is that an actuation cable, rather than a rigid link, is a part of the mechanical drive connection from the paint sprayer operator 26 to the bead dispenser gate operator 58 for opening the gate 56 when the sprayer operator 26 actuates the sprayer 12 to begin spraying. Actuation cables are themselves well known in the prior art. They consist of a core, usually in the form of a stranded wire and a surrounding conduit through which the core slides. Conduit end fittings receive the opposite ends of the conduit and are attached to respective conduit mounting arms to fix the ends of the conduit in stationery positions. Conduit mounting arms have a hole through which the conduit end fitting is inserted. The conduit end fittings are sometimes provided with a radial slot that runs lengthwise for insertion of the core into the conduit end fitting. A core connector (sometimes called a head, such as a barrel head) is secured to each of the opposite ends of the core. When the core connector at one end is moved to apply a tension force on the core, the core slides through the conduit and the core connector at the opposite end is moved.

The glass bead dispenser gate 56 is connected to the paint sprayer operator 26 in a manner that accomplishes three goals: (1) opening the bead gate 56 when the sprayer operator 26 initiates spraying; (2) closing the gate when the sprayer operator 26 stops the spraying; and (3) not actuating the sprayer operator 26 if the gate 56 is unintentionally forced open, such as by being pulled open as a result of being scraped or dragged along the pavement. The principal components of the drive connection between the paint sprayer operator 26 and the bead dispenser gate 56 are (1) the gate actuation cable 72 that is connected at its aft end 74 to the bead dispenser 50 and (2) a mechanical drive link connected between the forward end of the gate actuation cable 72 and the sprayer operator 26. The mechanical drive link is supported on the forward mounting block 42 and is arranged to cause the sprayer operator 26 to apply a tension force upon the core 76 for opening the bead gate 56 when the sprayer operator 26 actuates the sprayer 12 and for releasing the tension force when the sprayer operator 26 pivots to stop the spraying.

Looking at these components in more detail, the aft end of the gate actuation cable 72 has a conduit fitting 82 that is attached to the actuation cable mounting arm 65 of the bead dispenser 50. The core 76 of the gate actuation cable 72 extends through the bead gate bias spring 64 into attachment to the upper lever arm 59 of the bead gate operator 58. Consequently, if a tension force is applied to the opposite forward end of the core 76 of the gate actuation cable 72 and the tension force pulls the core 76 forward, that forward movement pulls the upper lever arm 59 of the gate operator 58 forward and opens the bead gate 56. However, an important observation to remember is that, if the bead gate 56 is dragged along the pavement and pulled open, no force is transmitted through the gate actuation cable 72. Instead, the resulting forward movement of the upper lever arm 59 of the gate operator 58 merely pushes (applies a compression force) on the core 76. The pushed core cannot overcome the friction in the actuation cable 72 and the friction and forces applied to the mechanical linkages at the forward end of the bead gate actuation cable 72. So instead, the pushed core 76 simply bends or droops into a smooth curve within the gate bias spring 64 with no translation of the core 76 inside its conduit. So no force is transmitted forward that would actuate the paint sprayer and cause an unintended application of paint to the pavement.

Figure 4:
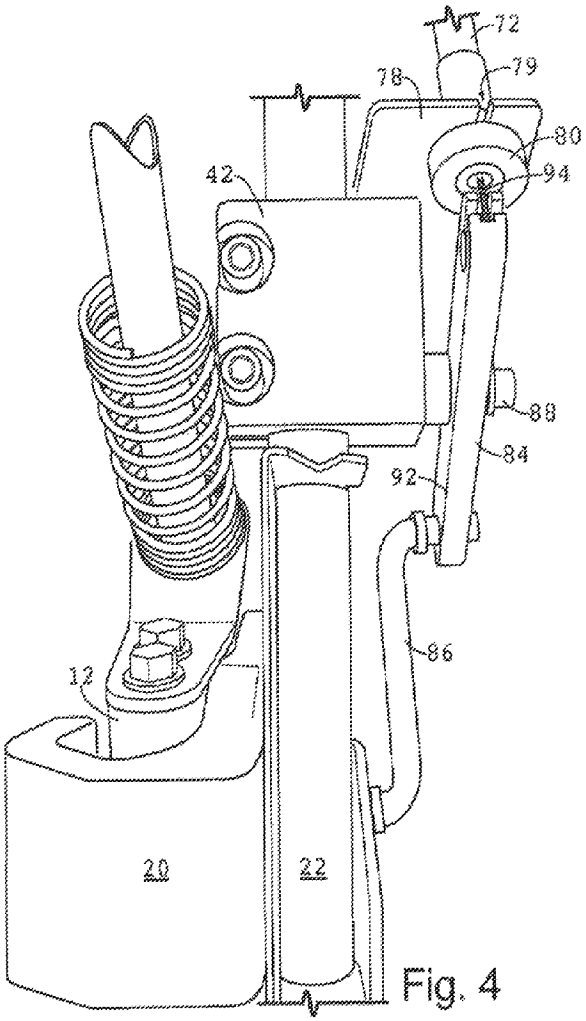
FIG. 4 is top view of a portion of the structures shown in FIG. 3 showing the sprayer gun cradle, and the forward mechanical drive link connected between the forward end of the gate actuation cable and the sprayer operator.
Figure 7:
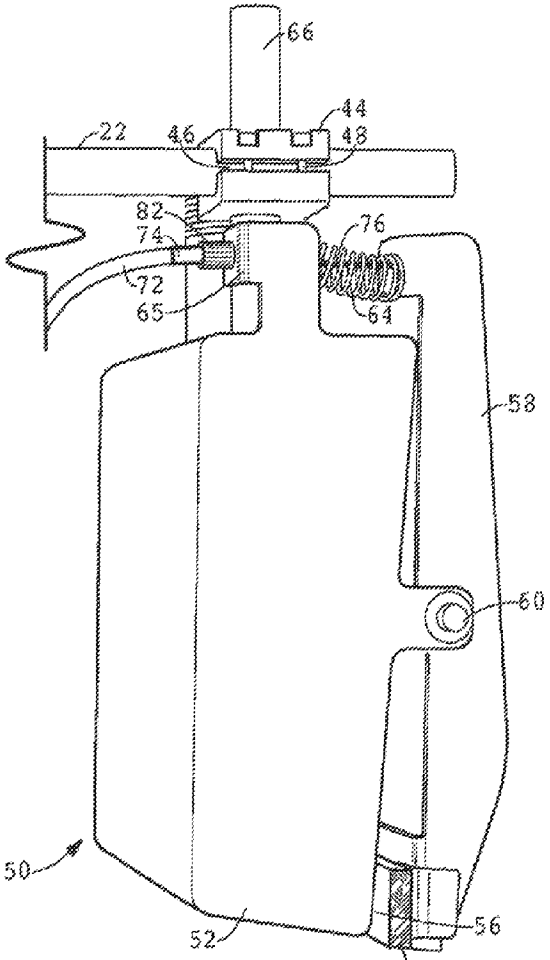
FIG. 7 is a side view of the glass bead dispenser and its connection to the dispenser gate actuation cable showing the dispenser gate in its open state.
Figure 6:
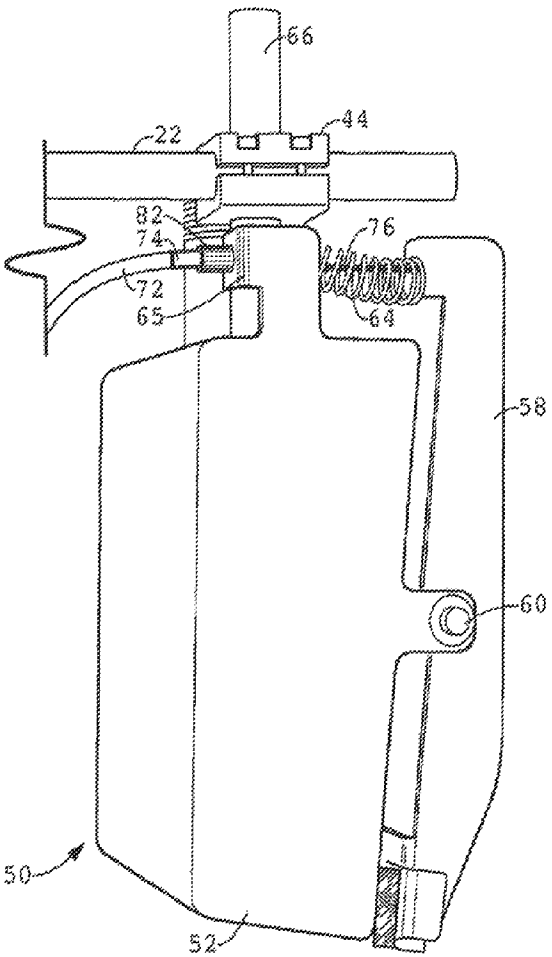
FIG. 6 is a side view of the glass bead dispenser and its connection to the dispenser gate actuation cable showing the dispenser gate in its closed state.

Referring principally to FIGS. 3 and 4, a cable conduit mounting arm 78 is attached to the forward mounting block 42 for removably attaching the conduit of the bead dispenser actuation cable 42 to the forward mounting block 42. The mounting arm 78 has a hole through which a cable conduit end fitting 80 is mounted. The mounting arm 78 also has a slot 79 extending from the hole to an outer periphery (the top) of the mounting arm 78 with a slot width greater than the diameter of the core 76 of the bead dispenser actuation cable 42. The slot 79 in the mounting arm 78 is aligned with a longitudinal slot in the conduit end fitting 80. This arrangement makes the core 76 of the bead dispenser actuation cable 42 quickly and easily removable from its attachment to the mounting arm 78 by merely pulling aft on the conduit of the gate actuation cable 72 to pull it out of the conduit end fitting 80 and then lifting up on the gate actuation cable 72 to pass its core 76 up through the aligned slots.

The mechanical drive link connecting the forward end of the gate actuation cable 72 to the sprayer operator 26 comprises (1) a direction-reversing bell crank 84 and (2) a sprayer operator connecting link 86 connecting the bell crank 84 to the sprayer operator 26. The direction-reversing bell crank 84 is pivotally mounted by a pivot axle 88 that is fixed to the forward mounting block 42. The preferred bell crank 84 includes a lever arm 90 that, in operable connection on the pavement line striper, extends upward from the pivot axle 88. A second lever arm 92 of the bell crank 84 extends downward from the pivot axle 88. Most preferably, the direction-reversing bell crank 84 is a 180° bell crank that is a simple lever having its lever arms extending in 180° opposite directions In order to removably attach the forward end of the actuation cable core 76 to the upper lever arm 90, a slot 94 bifurcates the upper end of the direction reversing bell crank 84 into two branches. A cross bore 96 extends through the two branches and across the slot 94 for receipt of a forward core fitting, preferably a barrel head connector 98, that is swedged or swaged onto the core 76 of the bead gate actuation cable 72. A radial slot 97 in at least one of the bifurcated branches permits passage of the core 76 into or out of the slot 94 for manual insertion or removal of the barrel head connector 98 into or out of the cross bore 96.

This arrangement allows for the very rapid and easy removal of the forward end of the bead gate actuation cable 72 from the forward mounting block. The previously described manipulations lift the core 76 out of the conduit end fitting 80 and then the forward core fitting 98 is slid laterally from the direction-reversing bell crank 84. The now free forward end of the bead gate actuation cable 72 is available for connection for manual bead application.

The sprayer operator connecting link 86 is connected so that a direction of rotation of the sprayer operator 26 that actuates the trigger 24 of the sprayer 12, also applies a tension on the dispenser gate actuation cable 72. The preferred sprayer operator connecting link 86 is pivotally connected to the lower lever arm 92 of the direction-reversing bell crank 84 and pivotally connected at the connecting link's opposite end to the paint sprayer operator 26. Preferably, the sprayer operator connecting link 86 is pivotally connected to the upwardly extending lever arm 31 of the sprayer operator 26 above the pivot axis 28 of the sprayer operator 26. The most preferred sprayer operator connecting link 86 is a shaft bent out in opposite directions at right angles at its ends. One bent out end is pivotally connected to a hole in the paint sprayer operator 26 and the opposite bent out end is pivotally connected to a hole near the lower end of the direction reversing bell crank 84.

Handle Bar for Manual Application of Glass Beads

Figure 8:
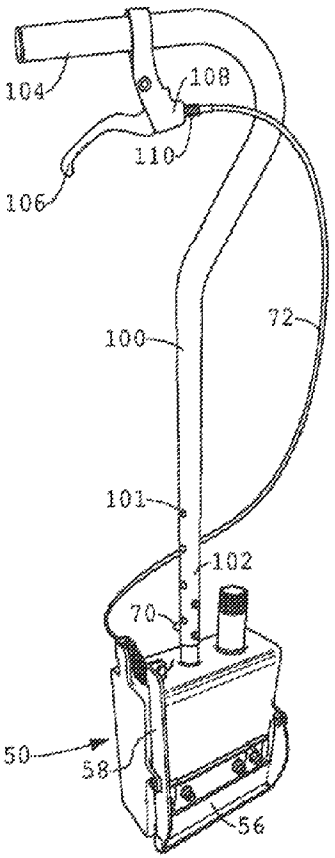
FIG. 8 is a view in perspective of an embodiment of the invention with the glass bead dispenser and its actuation cable attached to a handle bar for manual application of glass beads to fresh paint.

FIG. 8 shows a handle bar 100 to which the bead dispenser 50 and the forward end of the gate actuation cable 72 are attached after removal from the line striper as previously described. The handle bar 100 is a tube with its lower end 102 telescopically engaged with and attached to the upstanding support post 66 of the bead dispenser 50. More particularly, the lower end 102 of the handle bar 100 is provided with one or more diametrical holes 101. The upstanding bead dispenser support post 66 is slid into the bottom end of the handle bar 100 until one of the holes 68 through the support post 66 aligns with a hole 101 through the lower end 102 of the handle bar 100. The linchpin 70 is inserted through the aligned holes to secure the bead dispenser 50 to the bottom end of the handle bar 100.

The upper end 104 of the handle bar 100 is bent into a cane-like crook shape to permit a comfortable and secure grip by the painter. A hand-actuable lever 106, that is like a bicycle brake engagement lever, is attached to the upper end 104 in position for actuation by the painter. The hand-actuable lever 106 has an actuation cable mounting arm 108 to which is mounted an actuation cable conduit end fitting 110. The forward end of the actuation cable 72 (upper end when on the handle bar 100) is removably attachable to the actuation cable conduit end fitting 110 on the cable conduit mounting arm 108 of the handle bar 100 in the same manner as described above. Similarly, the forward core fitting 98 is removably attachable to the hand-actuable lever 106. Consequently, when the painter squeezes and pivots the hand-actuable lever 106, a tension force is applied to the actuation cable 72 to open the bead gate 56. Releasing the lever 106 allows the bead gate to be closed by its biasing spring 64.

It should be apparent that the length of the actuation cable should be at least long enough to allow adjustment of the fore and aft location of the bead dispenser along the horizontal support bar 22. The core of the actuation cable needs to be at least as long as the distance from the top end of the direction reversing bell crank 84 to the bead dispenser gate operator 58. However, the position of the bead dispenser 50 along the horizontal support bar is not critical. The proper opening and closing functions of the bead gate 56 are not affected by the position. As a result, no critical adjustment is required.

REFERENCE NUMBERS

10 wheeled carriage
12 paint sprayer
14 paint reservoir
16 high pressure paint pump
18 engine
20 spray gun cradle
22 horizontal support bar
24 paint spray trigger
26 paint sprayer operator
28 pivot axis of sprayer operator
29 forwardly extending lever arm of sprayer operator
30 finger for actuating sprayer trigger
31 upwardly extending lever arm of sprayer operator
32 sprayer actuation cable
34 sprayer actuation cable conduit fitting
35 sprayer conduit fitting support
36 core of sprayer actuation cable 32
38 core fitting for sprayer actuation cable 32
40 hand trigger for the line sprayer
42 forward mounting block
44 aft mounting block
46 slot in aft mounting block 44
48 threaded fasteners across slot 46
50 glass bead dispenser
52 glass bead container
54 bead container fill tube
56 bead dispenser gate
57 lower lever arm of bead gate operator 58
58 bead gate operator
59 upper lever arm of bead gate operator 58
60 pivot axle of bead gate operator
62 gasket on bead gate
64 bias spring on bead gate operator
65 mounting arm on bead dispenser for gate actuation cable
66 bead container support post
68 diametric holes through bead container support post
70 linchpin—through bead container support post
72 bead gate actuation cable
74 aft end of bead gate actuation cable
76 core of gate actuation cable
78 forward cable conduit mounting arm
79 slot in forward cable conduit mounting arm 78
80 forward cable conduit end fitting
82 aft conduit fitting of gate actuation cable
84 direction reversing bell crank
86 sprayer operator connecting link
88 pivot axle of direction reversing bell crank 84
90 upper lever arm of direction reversing bell crank 84
92 lower lever arm of bell crank 84
94 slot in upper end of upper lever arm 90
96 cross bore through upper end of 84 to receive a barrel head core connector
97 radial slot in direction reversing bell crank 84
98 barrel head connector
100 handle bar
102 lower end of handle bar
104 upper end of handle bar
106 hand actuable lever on handle bar 100
108 mounting arm on hand lever 106 for cable
110 cable conduit end fitting on handle bar 100

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A glass bead dispensing apparatus for alternatively being attached to a walk-behind pavement line striper or being manually held, the line striper including a paint sprayer, a horizontal support bar extending aft of the sprayer, a paint sprayer operator that initiates spraying when moved in one direction and stops spraying when returned in the opposite direction, the bead dispensing apparatus comprising:

(a) a forward mounting block attachable to the horizontal support bar;

(b) a glass bead dispenser having a bead container with a laterally oriented exit slot, the dispenser having a bead dispenser gate movable between a position blocking the exit slot and a position opening the exit slot, the gate having a gate operator for moving the gate between the two positions, the bead dispenser also having a spring applying a force moving the gate to the closed position and a dispenser support post fixed to the container;

(c) an aft mounting block attachable to the horizontal support bar aft of the forward mounting block, the support post of the bead dispenser being vertically, adjustable and fixable to the aft mounting block in a selected vertical adjustment;

(d) an actuation cable including a core, the cable having an aft end attached to the dispenser with the core attached to the gate operator for opening the gate in response to a tension force applied to an opposite forward end of the actuation cable core, the opposite forward end of the actuation cable being removably attachable to the forward mounting block with its core drivingly linked to the sprayer operator, the sprayer operator applying a tension force upon the core for opening the bead gate when the sprayer operator actuates the sprayer; and (e) a handle bar having a lower end telescopically engageable with and attachable to the upstanding support post of the bead dispenser, an upper end of the bar having a hand-actuable lever, the forward opposite end of the actuation cable core being removably attachable to the hand-actuable lever for manually opening the bead gate.

2. A glass bead dispensing apparatus that is convertible between attachment to a walk- behind pavement line striper for dispensing reflective glass beads onto a line freshly painted by the line striper and attachment to a hand-held handle for manually dispensing beads onto a freshly painted pavement traffic symbol, the line striper including a paint sprayer actuated by a paint sprayer trigger, a horizontal support bar extending aft of the sprayer, a movable paint sprayer operator mounted to the line striper and engaging the paint sprayer trigger to initiate spraying when moved in one direction and stopping spraying when returned in the opposite direction, the dispenser comprising:

(a) a forward mounting block attachable to the horizontal support bar;

(b) a direction-reversing bell crank pivotally mounted to the forward mounting block;

(c) a cable conduit mounting arm attached to the forward mounting block;

(d) a sprayer operator connecting link pivotally connected at a first lower end of a lower lever arm of the direction-reversing bell crank and pivotally connective at the connecting link's opposite end to the paint sprayer operator;

(e) a glass bead dispenser having a bead container with a laterally oriented exit slot, the dispenser having a bead dispenser gate movable between a position blocking the exit slot and a position opening the exit slot, the gate having a gate operator for moving the gate between the two positions, the bead dispenser also having a spring applying a force moving the gate to the closed position, an upstanding support post fixed to the container and an actuation cable conduit mounting arm spaced from the gate operator;

(f) an aft mounting block attachable to the horizontal support bar aft of the forward mounting block and having a bead dispenser support guide surface that is vertically aligned in the operable attached orientation of the aft mounting block, the upstanding support post of the bead dispenser being vertically adjustable along the guide surface and fixable to the aft mounting block in a selected vertical adjustment by a fastener;

(g) an actuation cable having an aft end conduit fitting attached to the actuation cable mounting arm of the dispenser and a core attached to the gate operator for opening the gate in response to a tension force applied to an opposite forward end of the actuation cable, the forward opposite end of the actuation cable being removably attachable to the cable conduit mounting arm of the forward mounting block and having a forward core fitting fixed to the core and removably attachable to a second upper lever arm of the direction-reversing bell crank; and (h) a handle bar having a lower end telescopically engageable with and attachable to the upstanding support post of the bead dispenser, an upper end of the bar having a hand-actuable lever and an actuation cable mounting arm, the forward opposite end of the actuation cable being removably attachable to the cable conduit mounting arm of the handle bar and the forward core fitting being removably attachable to the hand-actuable lever for manually opening the bead gate.

3. A glass bead dispensing apparatus according to claim 2 wherein (a) the direction-reversing bell crank has a lever arm that, in operable connection to the pavement line striper, extends upwardly from a pivot axis of the direction-reversing bell crank and is removably attachable to the forward end of the actuation cable core, the direction-reversing bell crank having a second lever arm that extends downward from its pivot axis, and (b) the sprayer operator connecting link is pivotally connected to the second lever arm of the direction reversing bell crank and is connectable in pivotal connection to the sprayer operator above a pivot axis of the sprayer operator.

4. A glass bead dispensing apparatus according to claim 3 wherein the cable conduit mounting arm that is attached to the forward mounting block has a hole through which a cable conduit end fitting is mounted and has a slot extending from the hole to an outer periphery of the mounting arm with a slot width greater than the diameter of the actuation cable core.

5. A glass bead dispensing apparatus according to claim 4 wherein the horizontal support bar is cylindrical and both mounting blocks have a cylindrical hole that is horizontally aligned in their operable orientation attached to the horizontal support bar and a slot extending from an outer surface of the mounting blocks parallel to the hole, the hole having a diameter greater than the diameter of the horizontal support bar so the mounting blocks are horizontally slidable along the horizontal support bar, the mounting blocks having fasteners extending across the slot for clamping the mounting blocks in a fixed position on the horizontal support bar.

6. A glass bead dispensing apparatus according to claim 5 wherein the sprayer operator connecting link is a shaft bent out in opposite directions at right angles at its ends, one bent out end pivotally connectable to a hole in the paint sprayer operator and the opposite bent out end pivotally connected to a hole in the direction reversing bell crank.

7. A glass bead dispensing apparatus according to claim 6 wherein the direction-reversing bell crank is a 180° bell crank having its lever arms extending in 180° opposite directions.

8. A walk behind, wheeled, pavement line striper having a glass bead dispensing apparatus that is convertible between attachment to the walk-behind pavement line striper and attachment to a hand-held handle for manually dispensing beads onto a freshly painted pavement traffic symbol, the line striper comprising:

(a) a wheeled carriage including a paint sprayer that is a hand operable paint spray gun detachably mounted to spray gun cradle and is actuated by a paint sprayer trigger, a horizontal support bar extending aft of the sprayer, a pivotable paint sprayer operator mounted to the line striper and engaging the paint sprayer trigger to initiate spraying when pivoted in one direction and stopping spraying when returned in the opposite direction;

(b) a forward mounting block mounted on and attached to the horizontal support bar;

(c) a cable conduit mounting arm attached to the forward mounting block;

(d) a glass bead dispenser having a bead container with a laterally oriented bead exit slot, the dispenser having a bead dispenser gate movable between a position blocking the exit slot and a position opening the exit slot, the gate having a gate operator for moving the gate between the two positions, the bead dispenser also having an upstanding support post fixed to the container and an actuation cable conduit mounting arm spaced from the gate operator;

(e) an aft mounting block mounted on and attached to the horizontal support bar aft of the forward mounting block, the aft mounting block having a bead dispenser support opening that is vertically aligned in the operable attached orientation of the aft mounting block, the dispenser support post extending upward through, and vertically adjustable within, the support opening and fixed by a fastener in a selected vertical position;

(f) an actuation cable having an aft conduit fitting attached to the actuation cable conduit mounting arm of the bead dispenser and having a core attached to the gate operator for opening the gate in response to a tension force applied to an opposite forward end of the actuation cable core, the opposite forward end of the actuation cable having a forward conduit fitting attached to the cable conduit mounting arm of the forward mounting block and a forward end of the core that is removably attached to a mechanical drive linkage that is connected to the paint sprayer operator, the mechanical drive linkage applying a tension force on the actuation cable core when the paint sprayer operator is moved to actuate the paint sprayer to a spraying state.

9. A line striper in accordance with claim 8 wherein the sprayer operator comprises a bell crank pivotally mounted to the horizontal support bar, the sprayer operator bell crank having an upwardly extending lever arm and a forwardly extending lever arm having a protruding finger that engages the paint sprayer trigger and initiates spraying when the upwardly extending lever arm is pivoted aft;

and the mechanical drive link comprises a direction-reversing bell crank pivotally mounted to the forward mounting block, the direction-reversing bell crank having a lever arm that extends upwardly from a pivot axis of the direction-reversing bell crank and is removably attached to the forward end of the actuation cable core, the direction-reversing bell crank having a second lever arm that extends downward from the pivot axis, and a sprayer operator connecting link pivotally connected to the second lever arm of the direction reversing bell crank and extending into pivotal connection to the upwardly extending lever arm of the sprayer operator bell crank above a pivot axis of the sprayer operator.

10. A line striper in accordance with claim 9 wherein both the cable conduit mounting arm that is attached to the forward mounting block and the forward conduit fitting that is attached to the cable conduit mounting arm of the forward mounting block are slotted with a slot width greater than the diameter of the actuation cable core.

11. A line striper in accordance with claim 10 wherein the horizontal support bar is cylindrical and both mounting blocks have a cylindrical hole that is horizontally aligned in their operable orientation attached to the horizontal support bar and a slot extending from an outer surface of the mounting blocks parallel to the hole, the hole having a diameter greater than the diameter of the horizontal support bar so the mounting blocks are horizontally slidable along the horizontal support bar, the blocks having fasteners extending across the slot for clamping the mounting blocks in a fixed position on the horizontal support bar.

12. A line striper in accordance with claim 11 wherein the sprayer operator connecting link is a shaft bent out in opposite directions at right angles at its ends, one bent out end pivotally connected to a hole in the paint sprayer operator and the opposite bent out end pivotally connected to a hole in the direction reversing bell crank.

13. A line striper in accordance with claim 12 wherein the direction-reversing bell crank is a 180° bell crank having its lever arms extending in 180° opposite directions.

* * * * *